US006261016B1

(12) United States Patent
Liu

(10) Patent No.: US 6,261,016 B1
(45) Date of Patent: Jul. 17, 2001

(54) MULTI-FUNCTIONAL REPLACEABLE PEN

(76) Inventor: Tsang-Jenn Liu, No. 11, Lane 61, Fu Le St., Hsinchuang City, Taipei Hsien (TW)

( * ) Notice: Subject to any disclaimer, the term of this patent is extended or adjusted under 35 U.S.C. 154(b) by 0 days.

(21) Appl. No.: 09/598,686

(22) Filed: Jun. 21, 2000

(30) Foreign Application Priority Data

Jun. 25, 1999 (CN) ..... 99214418

(51) Int. Cl.[7] ..... B43K 24/14
(52) U.S. Cl. ..... 401/116; 401/99; 401/195
(58) Field of Search ..... 401/116, 99, 195

(56) References Cited

U.S. PATENT DOCUMENTS 2,565,556 * 8/1951 Gruber ..... 401/116
4,221,490 * 9/1980 Malm ..... 401/116 X
4,529,328 * 7/1985 Wacha et al. ..... 401/116 X
5,483,429 * 1/1996 Chu ..... 401/195 X
5,806,164 * 9/1998 Wilks ..... 401/99 X

* cited by examiner

*Primary Examiner*—Gregory L. Huson
*Assistant Examiner*—Kathleen J. Prunner
(74) *Attorney, Agent, or Firm*—Rosenberg, Klein & Lee

(57) ABSTRACT

A multi-functional pen has a tapered tube head connected to a lower pen tube which houses a rotary device. The rotary device projects from the lower pen tube at one end. An upper pen tube is connected to the projecting end of the rotary device so as to complete the pen when the tube head, lower pen tube, rotary device and upper pen tube are assembled together. A refill is disposed within the pen and can be replaced by unscrewing any one of the tube head, the upper pen tube or the lower pen tube.

2 Claims, 9 Drawing Sheets

MULTI-FUNCTIONAL REPLACEABLE PEN

FIELD OF THE INVENTION

The present invention relates to a multi-functional replaceable pen, especially, by the present invention, a pen with a rotary device can be used more conveniently, and provides various shapes and configurations to the pens.

BACKGROUND OF THE INVENTION

With reference to FIGS. 1 and 2, a schematic perspective view and an exploded schematic perspective view of a prior art rotary device in a pen are illustrated. The pen mainly includes a tube body A. a refill B and a refill sleeve C.

The tube body A is formed by combining an upper pen tube A1 and a lower pen tube A2. The rotary device A3 is installed in the upper edge of the lower pen tube A2.

When inserting the refill B into the refill sleeve C for being inserted further into the tube body A, the upper pen tube A1 and the refill sleeve C must be pulled out oppositely. Then the refill sleeve C of the refill B is inserted into the rotary device A3. Finally, the holding ring A11 of the upper pen tube A1 is tightly combined with the plurality of holding strips A22 on the outer ring A21 of the lower pen tube A2.

Since the rotary device A3 of the prior art pen is mostly installed between the upper pen tube A1 and lower pen tube A2, the structure and shape of the rotary pen is confined. If it is desired to update the refill B, the upper pen tube A1 and lower pen tube A2 are necessary to be pulled away.

Therefore, there is an eager demand for a novel multi-functional replaceable pen, in which the rotary device is displaced from a prior art position. Thereby, the shapes and functions of the pen can be varied.

SUMMARY OF THE INVENTION

Accordingly, the primary object of the present invention is to provide a multi-functional replaceable pen by which the manufacturer of pens may design pens with various functions or outlooks.

Another object of the present invention is to provide a multi-functional replaceable pen, by which the refill can be replaced from a plurality of positions of the pen.

The various objects and advantages of the present invention will be more readily understood from the following detailed description when reading in conjunction with the appended drawing.

DETAILED DESCRIPTION OF THE PREFERRED EMBODIMENTS

Figure 1:
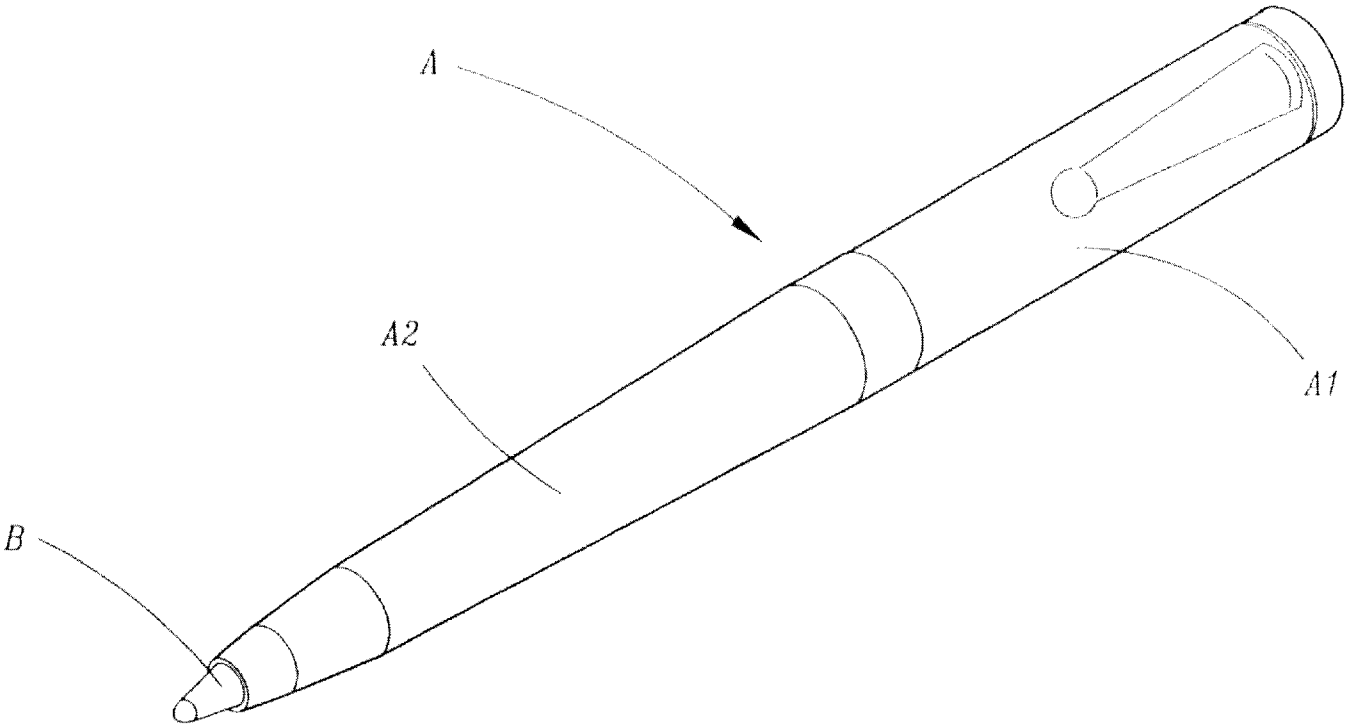
FIG. 1 PRIOR ART
FIG. 1 is a perspective view of a prior art pen.
Figure 2:
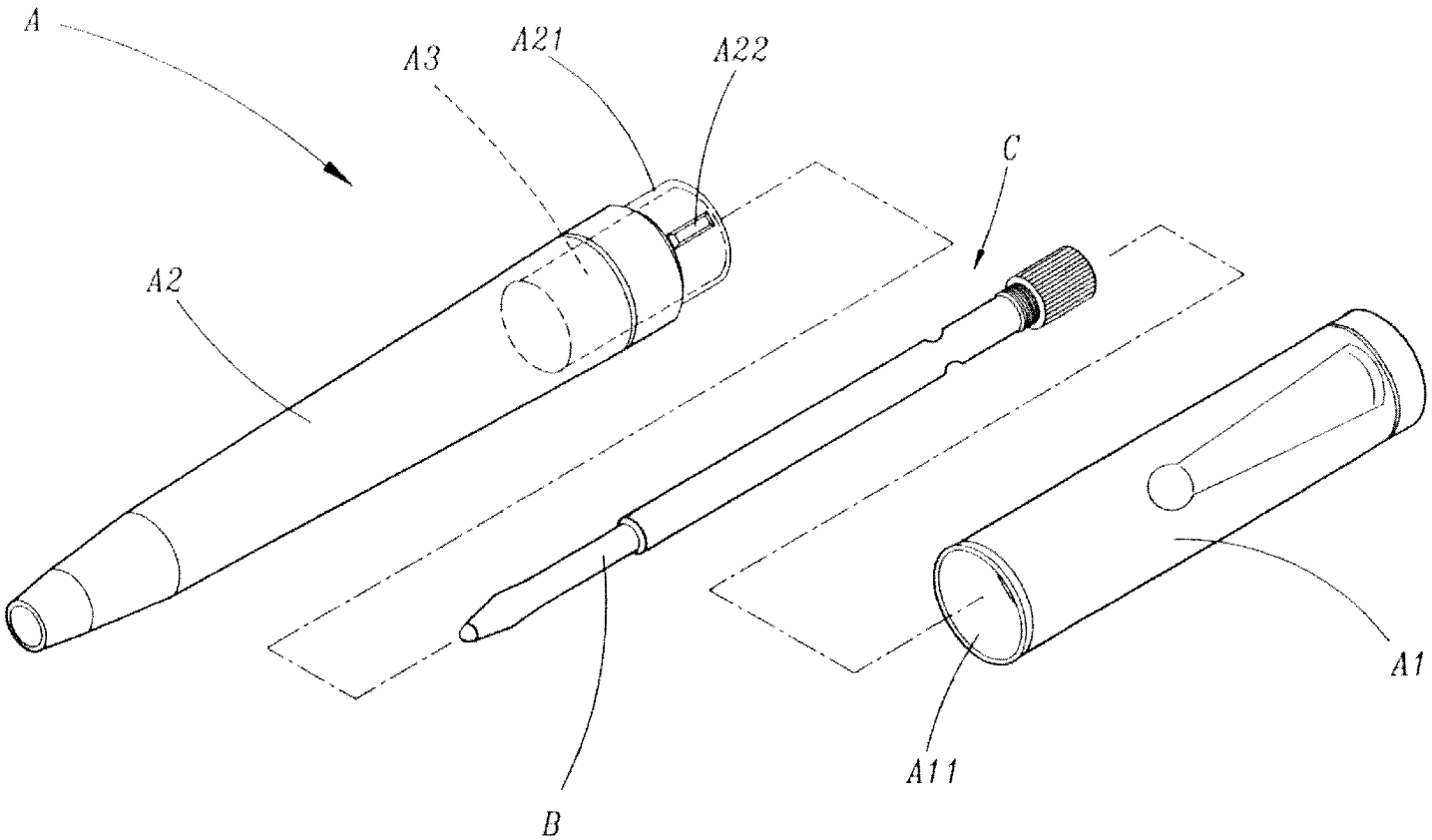
FIG. 2 PRIOR ART
FIG. 2 is an exploded schematic perspective view of a rotary type pen in the prior art.
Figure 3:
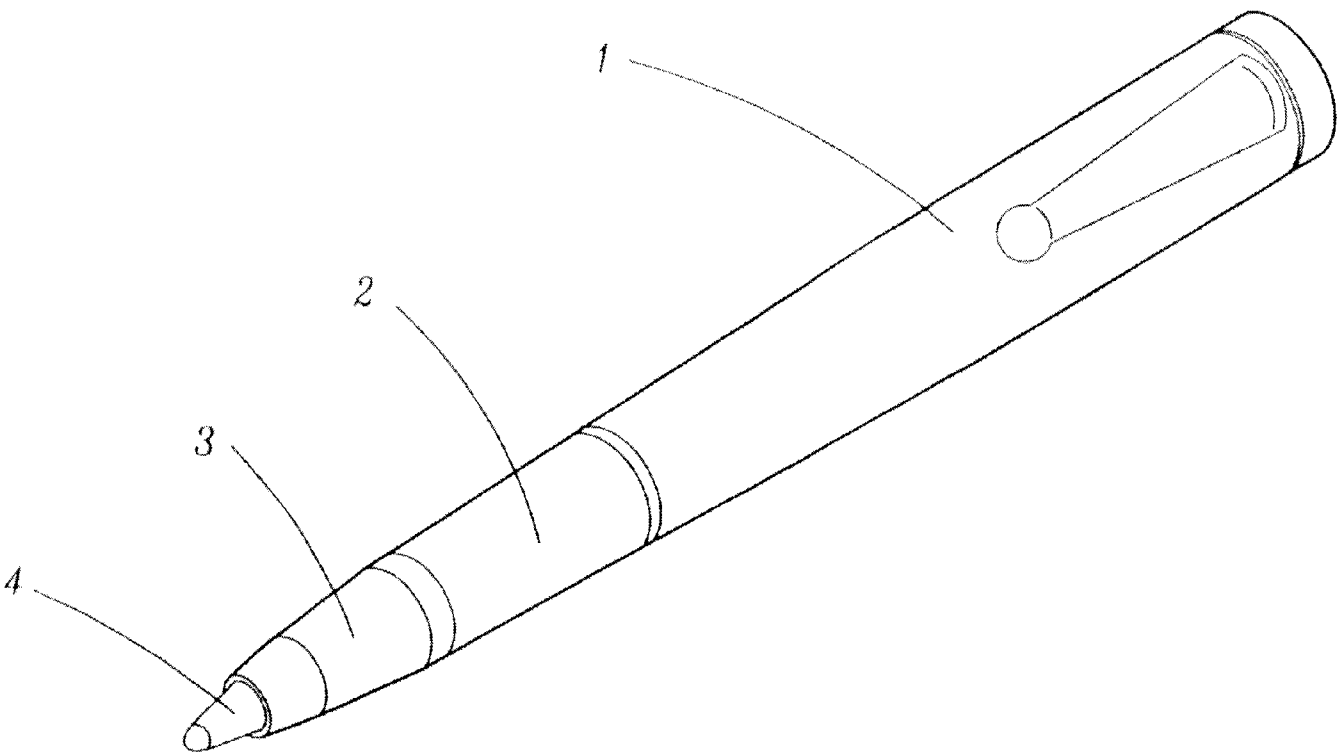
FIG. 3 is a schematic perspective view of a multi-functional replaceable pen of the present invention.
Figure 4:
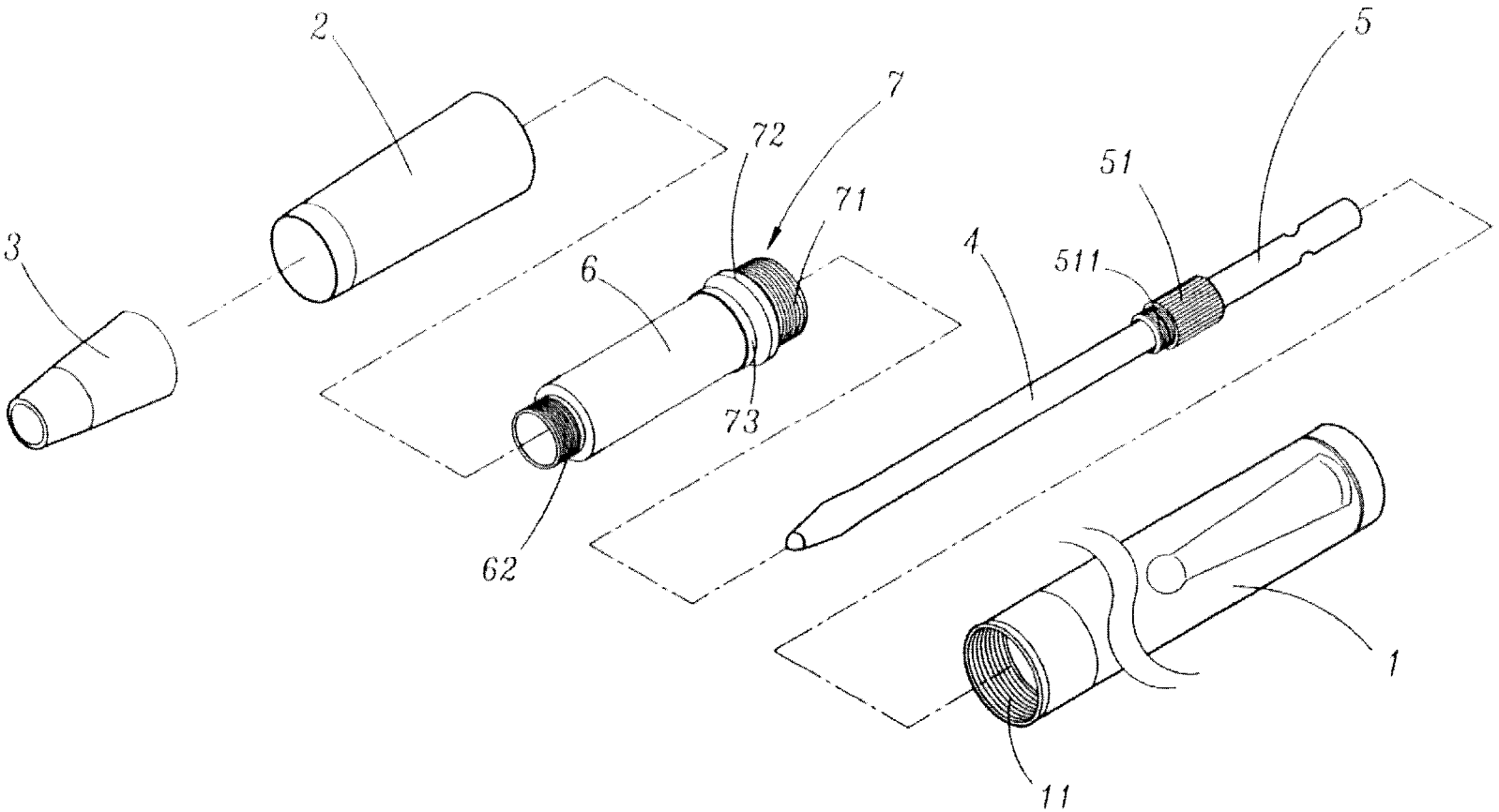
FIG. 4 is a structural exploded perspective view of the multi-functional replaceable pen of the present invention.
Figure 5:
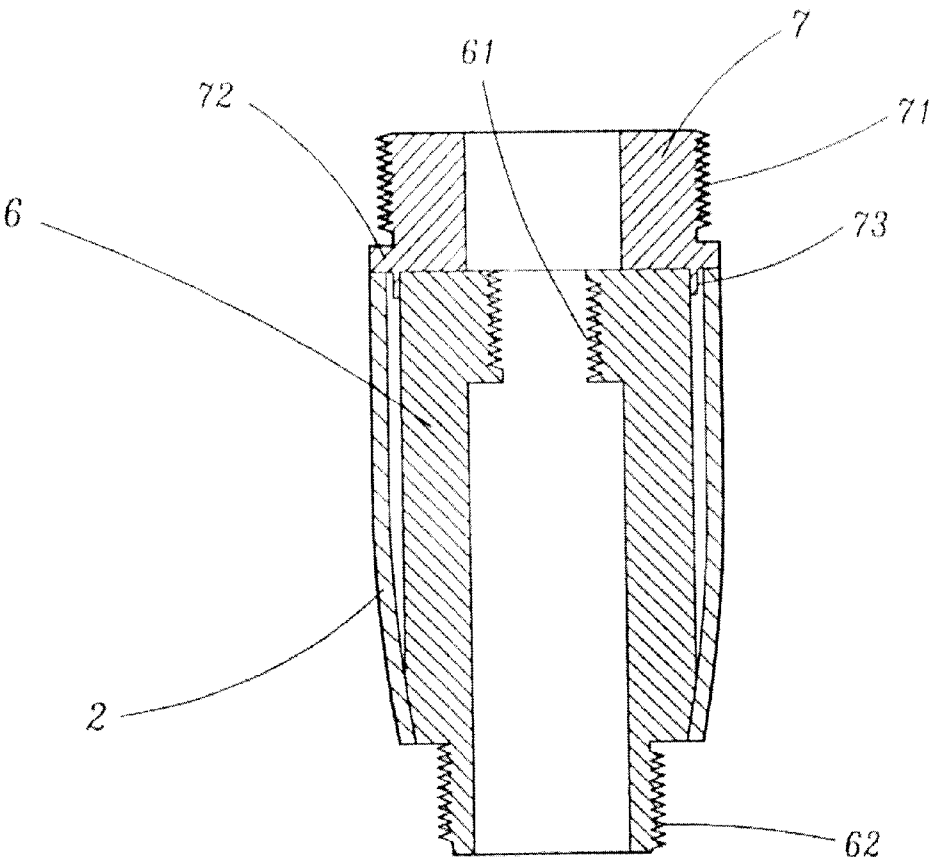
FIG. 5 is a cross sectional view showing the rotary device of the multi-functional replaceable pen of the present invention.

With reference to FIGS. 3, 4, and 5, a schematic perspective view an exploded perspective view of the multi-functional replaceable pen in the present invention and a cross sectional view of the rotary means of the multi-functional replaceable pen according to the present invention are illustrated. The multi-functional replaceable pen of the present invention mainly includes an upper pen tube 1, a lower pen tube 2, a tube head 3, a refill 4, a refill sleeve 5, a rotary device 6 and a scat 7 for a fixing cover.

The upper pen tube 1 is a tube body and the lower edge thereof is installed with an inner thread 11.

The lower pen tube 2 is a hollow tube body.

The tube head 3 is a hollow taper.

The refill 4 is a slender and long tube body.

The refill sleeve 5 is a slender hollow tube body, and one end thereof is installed with a tooth ring 51, while one end of the tooth ring 51 has an outer thread 511.

The rotary device 6 serves to cause the refill 4 to be screwed out and in. The inner wall of the rotary device is formed with an inner thread 61, and the lower edge thereof is formed with an outer thread 62.

The seat 7 for a fixing cover is a hollow body, and one end thereof is formed with an outer thread 71. The middle section of the seat is formed with a larger positioning ring 72, while another end of the seat has a fastening ring 73.

In the assembly of the present invention, the seat 7 is tightly connected to one end of the rotary device 6. Then, they are inserted into the lower pen tube 2 at an end having a larger diameter. The positioning ring 72 will abut against the large diameter end of the lower pen tube 2, while another end of the rotary device 6 will protrude through the other open end of the lower pen tube 2 having a smaller diameter. Then, tube head 3 of the pen is screwedly tightened along the outer thread 62 of the rotary device 6. Then. the refill 4 is inserted into the refill sleeve 5. The outer thread 51 thereof is engaged with the inner thread 61 in the rotary device 6 within the seat 7. Finally, the inner thread 11 of the upper pen tube 1 is screwedly connected with the outer sleeve 71 of the seat 7.

The connection of the upper pen tube 1 and the seat 7 is not confined by the aforesaid screwed connection.

Figure 6:
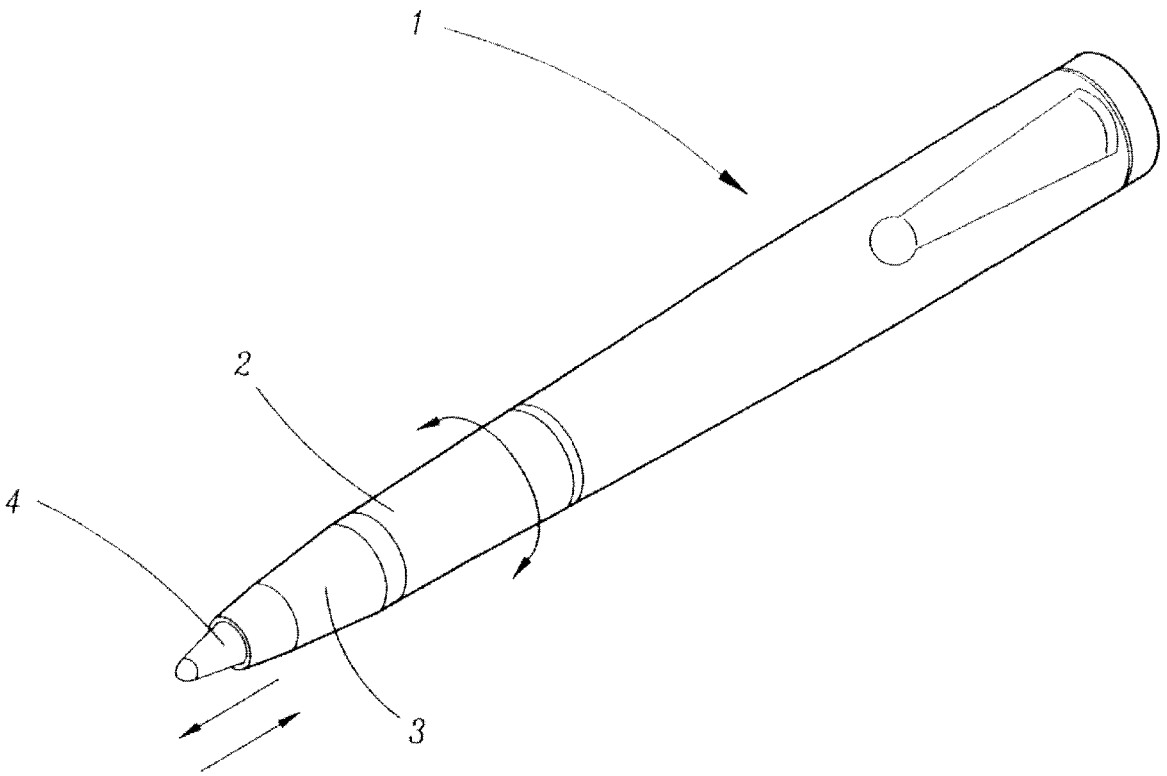
FIG. 6 is a schematic perspective view showing the use of the multi-functional replaceable pen of the present invention.

Referring to FIG. 6, the schematic perspective view of the multi-functional replaceable pen in the present invention is illustrated. It can be known from the figure that the position of the rotary device 6 is exactly the position held by a person.

Figure 7:
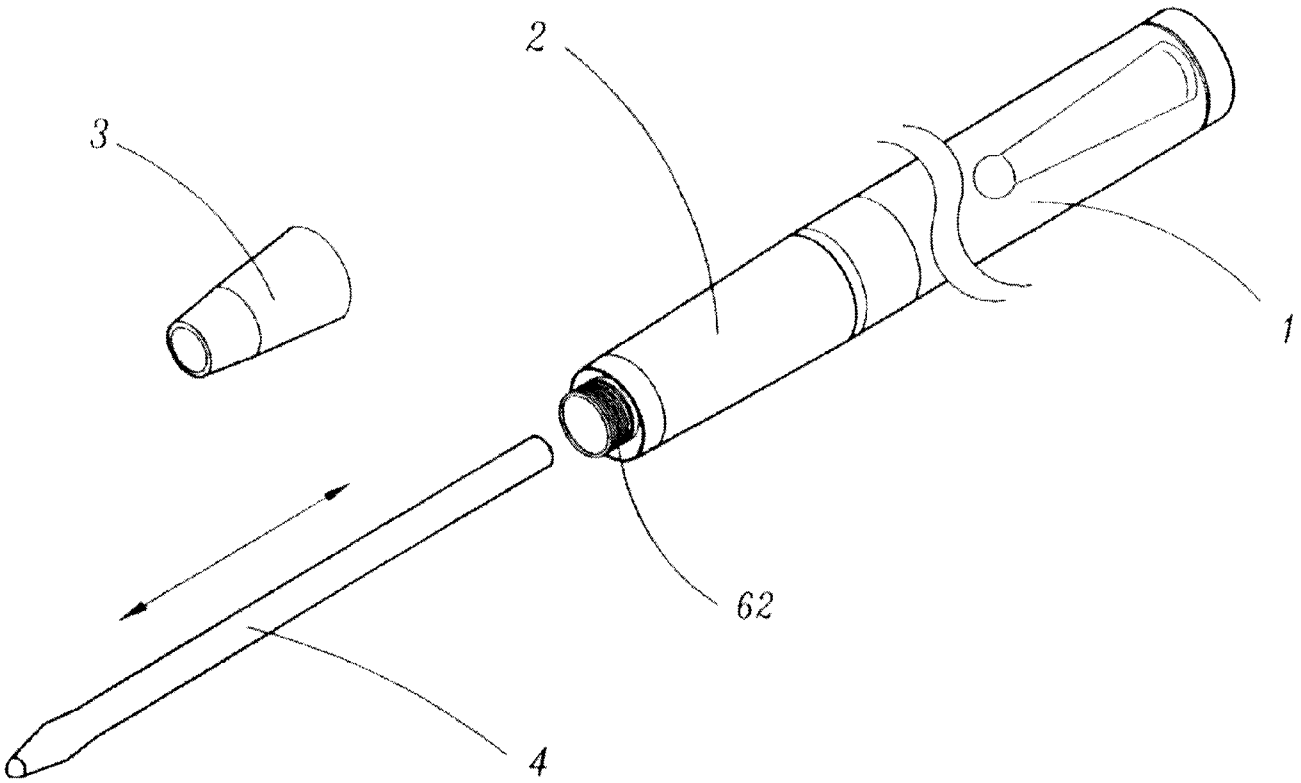
FIG. 7 is a schematic perspective view showing the updating of the refill in the multi-functional replaceable pen according to the present invention.

With reference to FIG. 7, a schematic perspective view for updating the refill of the multi-functional replaceable pen according to the present invention is illustrated, wherein the refill 4 is replaced. It can be appreciated that when it is desired to update or replace the refill 4, it is only necessary to screw out the tube head 3 and then insert the new refill 4 thereinto. Then, the tube head 3 is screwed on tightly.

Figure 8:
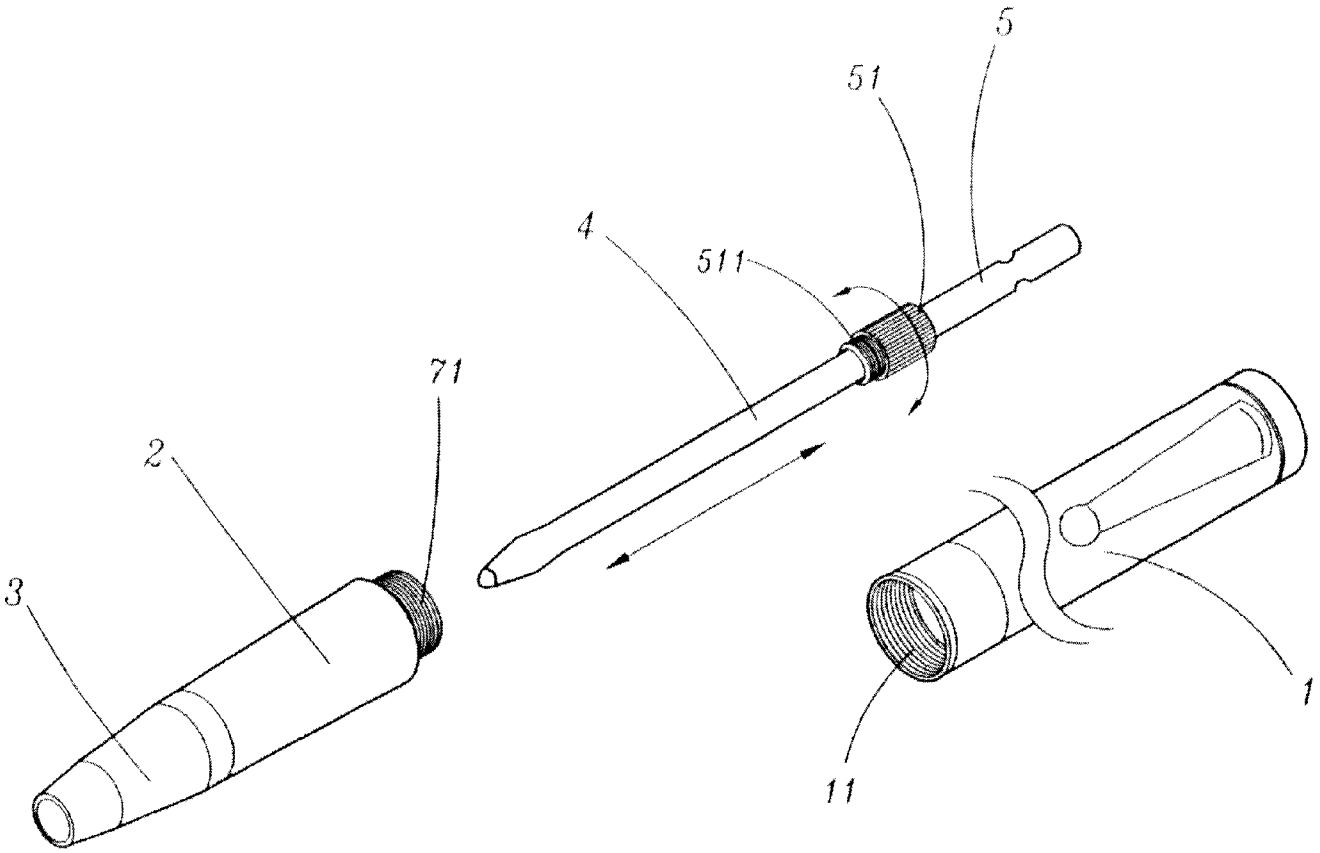
FIG. 8 is a schematic perspective view showing the updating of the refill in the multi-functional replaceable pen according to the present invention.

Referring to FIG. 8, a schematic perspective view for updating the refill of the multi-functional replaceable pen according to the present invention is illustrated, wherein the refill 4 is replaced. It can be appreciated that when it is desired to update the refill 4, the upper pen tube 1 can screw out. Then the refill sleeve 5 and the refill 4 are screwed out. Then a new refill 4 is placed in the refill sleeve 5. Next, the refill sleeve 5 and the upper pen tube 1 can be screwed together tightly.

Figure 9:
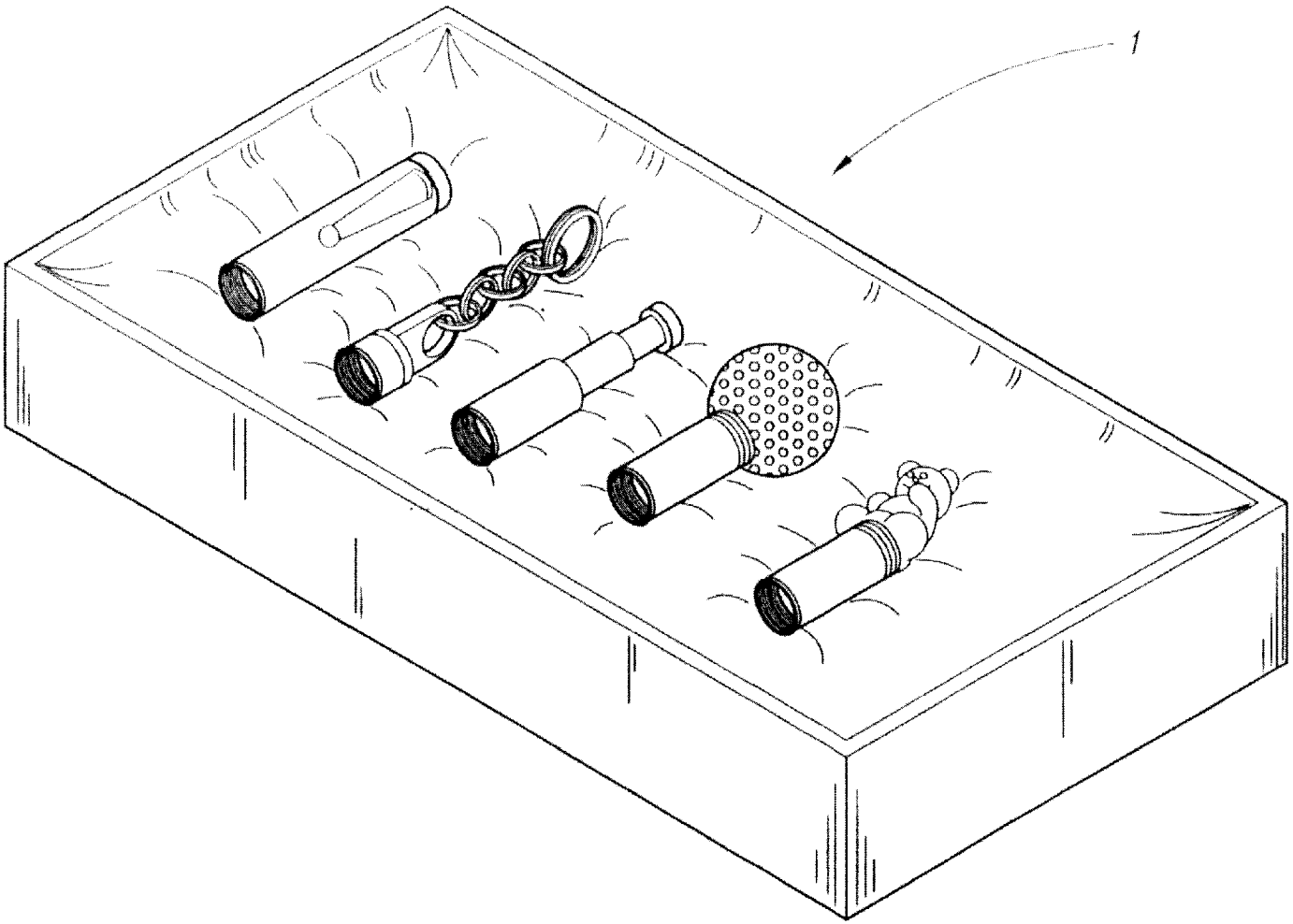
FIG. 9 is a schematic view showing the assembly of the multi-functional replaceable pen according to the present invention.

With reference to FIG. 9, an assembled schematic view of the multi-functional replaceable pen according to the present invention is illustrated therein. It can be appreciated that the present invention can be used with various tube bodies 1.

In summary, in the present invention, the rotary device in the prior art design can be displaced. The refill of a pen can be replaced directly in the upper pen tube of the tube head or in the lower pen tube. By the structure of the present invention, the design of the upper pen tube can be varied.

Although the present invention has been described with reference to the preferred embodiments, it will be understood that the invention is not limited to the details described therein. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-functional replaceable pen having a refill which is replaced from a tube head, an upper pen tube or a lower pen tube of the pen, wherein the upper pen tube has various designs, the pen comprising:

the upper pen tube being a tube body having a lower edge thereof being formed with inner threads;

the lower pen tube being a tapered hollow tube body;

the tube head being hollow and tapered;

the refill being a slender and long tube body;

a refill sleeve being a slender hollow tube body, with one end thereof being formed with a tooth ring, while one end of the tooth ring having outer threads;

a rotary device for causing the refill to be screwed in and out of position within the pen and being an elongated hollow tube body having an inner wall formed with threads and a lower edge thereof being formed with outer threads; and a seat on one end of the rotary device and being an elongated hollow body with one end thereof being formed with outer threads, a middle section being formed with an outer positioning ring, and the other end having a fastening ring;

wherein in assembly, the seat is screwedly connected and tightened to the one end of the rotary device; then the seat with the attached rotary device is inserted into the lower pen tube at its larger sized end such that the positioning ring abuts against the larger sized end, while the other end of the rotary device will protrude from the smaller sized end of the lower pen tube; the tube head of the pen is screwedly tightened along the outer threads of the rotary device; then, the refill is inserted into the refill sleeve such that the outer threads thereof being engaged with the inner threads in the rotary device; finally, the upper pen tube is screwedly connected to the outer threads of the seat.

2. The multi-functional replaceable pen as claimed in claim 1, wherein the upper pen tube is designed of various sizes and with different functions.

* * * * *